US010576601B2

(12) United States Patent
Carambot et al.

(10) Patent No.: US 10,576,601 B2
(45) Date of Patent: Mar. 3, 2020

(54) EXTENSION OPERATING DEVICE FOR POWER TOOLS

(71) Applicants: Omar Carambot, Orlando, FL (US); William Figueroa, Orlando, FL (US)

(72) Inventors: Omar Carambot, Orlando, FL (US); William Figueroa, Orlando, FL (US)

( * ) Notice: Subject to any disclaimer, the term of this patent is extended or adjusted under 35 U.S.C. 154(b) by 227 days.

(21) Appl. No.: 15/865,536

(22) Filed: Jan. 9, 2018

(65) Prior Publication Data

US 2019/0210180 A1 Jul. 11, 2019

(51) Int. Cl.

| | |
|---|---|
| ***B24B 23/00*** | (2006.01) |
| ***B27B 9/04*** | (2006.01) |
| ***B28D 7/00*** | (2006.01) |

(52) U.S. Cl.

CPC ..... *B24B 23/005* (2013.01); *B27B 9/04* (2013.01); *B28D 7/00* (2013.01)

(58) Field of Classification Search

CPC ..... B24B 23/005; B24B 23/02; B24B 23/024; B27B 9/04; B28D 7/00

USPC ..... 451/363, 352, 353

See application file for complete search history.

(56) References Cited

U.S. PATENT DOCUMENTS

| | | | | |
|---|---|---|---|---|
| 5,788,561 | A * | 8/1998 | Pearlman | B24B 7/186 125/13.01 |
| 6,623,342 | B1 | 9/2003 | McDonald | |
| 6,793,567 | B1 * | 9/2004 | Corkill | A47L 11/162 451/350 |
| 7,469,694 | B2 * | 12/2008 | Howard | B27B 9/02 125/13.01 |
| 7,704,123 | B2 * | 4/2010 | Marsic | B28D 7/00 125/13.01 |
| 2003/0166386 | A1 * | 9/2003 | McDonald | B24B 23/005 451/360 |
| 2004/0045108 | A1 * | 3/2004 | Fellhauer | A47L 11/16 15/49.1 |
| 2014/0369019 | A1 | 12/2014 | Sabia | |
| 2018/0290328 | A1 * | 10/2018 | Zuler | B23Q 9/005 |
| 2018/0347124 | A1 * | 12/2018 | Lorenz | B28D 1/18 |

* cited by examiner

*Primary Examiner* — George B Nguyen

(74) *Attorney, Agent, or Firm* — Dunlap Bennett & Ludwig PLLC

(57) ABSTRACT

An assembly for supporting the extended operation of mounted power hand tools is provided. The power tool extension apparatus extends between a baton-style handle and a depth-adjusting single wheel correlated to enable the operator to control the mounted power hand tool in a one-handed walk along manner. The alignment of the power tool extension apparatus, the mounted power tool, and the centrally disposed single wheel facilitates a wide range of selective pivotal motion of the single wheel and thus the mounted power tool about the extension apparatus.

10 Claims, 4 Drawing Sheets

EXTENSION OPERATING DEVICE FOR POWER TOOLS

BACKGROUND OF THE INVENTION

The present invention relates to power hand tools and, more particularly, to an assembly for supporting the extended operation of power hand tools.

The use of power hand tools inherently requires the operator to be within arms' length of the working surface. As a result, power tools adapted to be used at the ground level, such as using a grinder to cut or clean expansion joints in the concrete coatings and concrete polishing industries, inherently require the operator to be bent or hunched over during operation.

The prior art does include accessories for supporting power tools, thereby extending the arms' length of the user. However, such extension accessories aim at solving this on-going problem by placing a clumsy piece of equipment between the operator and the work surface. For instance, current extension accessories provide only rigid mounting and thereby lack the control and certainty available to the operators using the power tools by hand. This is particularly relevant to the abovementioned exemplary use of a grinder following an expansion joint precisely, wherein current extension accessories rigidly hold an angle grinder, while balanced on multiple wheels, both of which unnecessarily limits the operable agility. Thereby current extension accessories provide a cumbersome experience, lacking any feel and control, which is critical to the ability of following curved contours and paths, such as curved expansion joints.

As can be seen, there is a need for an assembly for supporting the extended operation of power hand tools that, in effect, enables the extension of the operator's arm with nothing coming between the user and the work surface, thereby not only eliminating the need to be bent over but also enabling a one-handed walk along experience of the mounted hand power tool. For example, the present invention enables the mounting of most common angle grinders, for cutting or cleaning out expansion joints, with control and comfort. The present invention embodies a forearm supporting, baton style handle for control and comfort, while the weight is supported and balanced on a depth adjusting single wheel. By supporting the weight of the power hand tool on a single wheel, and through the use of a baton style handle, the present invention is able to bank both right and left with just the twist of the operator's wrist, enabling endless work paths and contours to be followed. The present invention also provides height adjustment functionality.

SUMMARY OF THE INVENTION

In one aspect of the present invention, an apparatus for supporting an extended operation of a mounted power hand tool along a working surface includes a pole extending from a handle portion and a wheel portion; a single wheel rotatably mounted to a first side of the wheel portion, wherein a circumference of the single wheel extends farther than the wheel portion so that the single wheel pivots relative to a longitudinal axis of the pole when the single wheel engage the working surface; and at least one bracket attached to said first side upward of the single wheel so that the single wheel is centrally disposed between an applicator of the mounted hand tool and said longitudinal axis.

In another aspect of the present invention, the apparatus for supporting an extended operation of a mounted power hand tool along a working surface includes a pole extending from a handle portion and a wheel portion; a single wheel rotatably mounted to a first side of the wheel portion, wherein a circumference of the single wheel extends farther than the wheel portion so that the single wheel pivots relative to a longitudinal axis of the pole when the single wheel engage the working surface; and at least one bracket attached to said first side upward of the single wheel so that the single wheel is centrally disposed between an applicator of the mounted hand tool and said longitudinal axis; a plurality of position slots spaced apart along a longitudinal length of the wheel portion, wherein the single wheel can be operatively associated with any of the plurality of position slots, whereby the extension of said circumference relative to the wheel portion is selectively adjustable; a baton-style handle connected to the handle portion, the baton-style handle providing a cuff pole telescopically connected to the handle portion; a handle transversely extending from a lower end of the cuff pole; and a cuff extending from an upper end of the cuff pole so that the cuff and the handle are spaced apart and aligned along a length of the cuff pole, wherein the cuff pole comprises an upper cuff pole telescopically connected to a lower cuff pole so that a distance between the spaced apart cuff and the handle is selectively adjustable, and wherein the cuff further comprises an adjustable strap; the apparatus further including an auxiliary handle connected to the cuff pole downward of and aligned with the handle; and a power source for the mounted power hand tool, the power source connected to the handle portion.

These and other features, aspects and advantages of the present invention will become better understood with reference to the following drawings, description and claims.

DETAILED DESCRIPTION OF THE INVENTION

Figure 1:
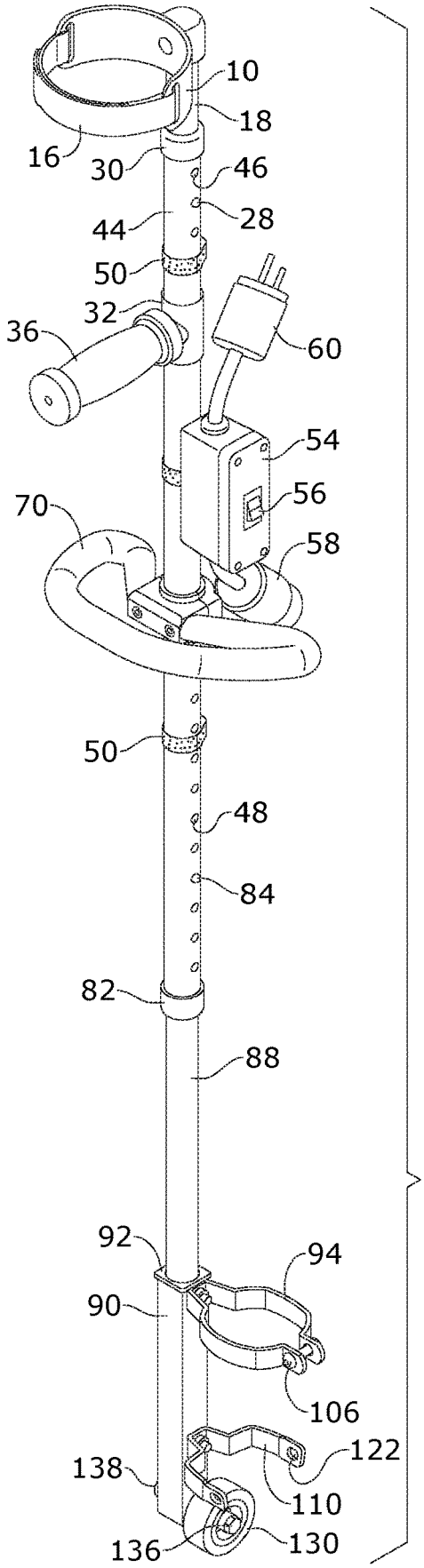
FIG. 1 is a perspective view of an exemplary embodiment of the present invention.
Figure 2:
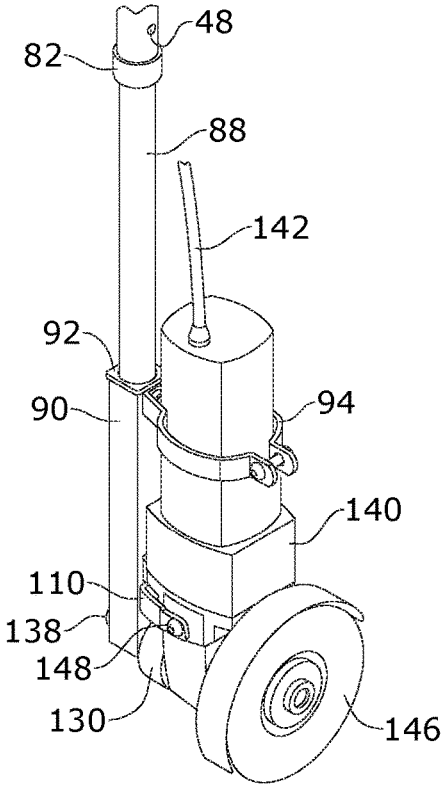
FIG. 2 is a detailed perspective view of an exemplary embodiment of the present invention, demonstrating mounting of an exemplary grinder.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Broadly, an embodiment of the present invention provides an assembly for supporting the extended operation of mounted power hand tools. The power tool extension apparatus extends between a baton-style handle and a depth-adjusting single wheel correlated to enable the operator to control the power hand tool in a one-handed walk along manner. The alignment of the power tool extension apparatus, the mounted power tool, and the centrally disposed single wheel facilitates a pivotal motion of the single wheel and thus mounted power tool about the extension apparatus.

It should be understood by those skilled in the art that the use of directional terms such as upper, lower, upward, downwardly, top and the like are used in relation to the illustrative embodiments as they are depicted in the figures, the upward direction (or upper) being toward the top of the corresponding figures and a downward direction being toward the bottom of the corresponding figure.

Referring to FIGS. 1 through 8C, the present invention may include a power tool extension apparatus 200 extending between a baton-style handle 25 and a depth-adjusting single wheel 130.

The baton-style handle 25 may include a cuff 10 transversely joined to a proximal/upper end of a cuff pole 18. The cuff 10 may mount to said proximal/upper end by way of a mounting sleeve 12 and/or cuff fastener components 20 and 22. The cuff 10 may provide an arcuate-shaped material dimensioned to engage a portion of an operator's arm. The cuff 10 may provide strap slots 14 for slidably receiving a strap 16 for securing the cuff 10 to said portion of the operator's arm by way of a removably fastener, such as a hook and loop fastener.

The distal/lower end of the cuff pole 18 may attach to a handle 34 so that the cuff 10 and handle 34 extend from the cuff pole 18 in a generally parallel, spaced-apart orientation relative to each other, the cuff 10 being upward of the handle 34. The handle 34 may provide a gripping surface 36.

Figure 6:
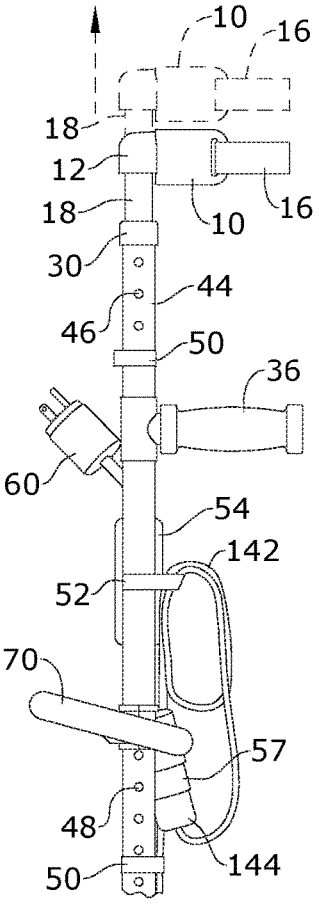
FIG. 6 is a detail side view of an exemplary embodiment of the present invention, demonstrating the selective height adjustment of a main pole and operatively engaged cuff pole.

The handle 34 may be joined to the cuff pole 18—and the baton-style handle 25 connected to a proximal end of a main pole 44—by way of a mounting components 38 and 40, a dust cap 30, and snap button components 26 and 28. The proximate/upper end of the main pole 44 may provide a series of spaced apart upper adjustment holes 46 through which the snap components 26 and 28 may selectively associate in a telescopic manner to provide adjustable functionality. Specifically, the baton-style handle 25 may movable between an extended and a contracted condition, as illustrated in FIG. 6, during use so as to conform to the operator to provide forearm supporting, and so enabling operational control and comfort.

The power tool extension apparatus 200 may include, downward of the handle 34, an auxiliary handle 70 attachable to the main pole 44 by way of mounting handle cap 68 and related components 72, 74, 76, 78, and 80. The auxiliary handle 70 may be shaped and dimensioned to be grippable and still assist in supporting the weight of the operator's arm.

The power tool extension apparatus 200 may include, downward of the handle 34, a power source 54 attachable to the main pole 44 by way of mounting components 62, 65, and 66. The power source 54 may include a power switch 56 and male and female electrical connectors 60 and 58. The power source 54 is adapted to provide power to the mounted power tool 140 by way of electrical connections 122, 142, and 148. Such a remote power switch 56 adds a level of safety, enabling the operatively associated power tool 148 to remain in the on position and making the on and off operation accessible from either of the attachments handles 34 and 70. Such electrical connections 122, 142, and 148 may be secured to the main pole 44 by straps with a plurality of removably fasteners 50 and 52, whereby excess cords of the power tool 140 may be secured safely and in an unencumbered manner.

Figure 5:
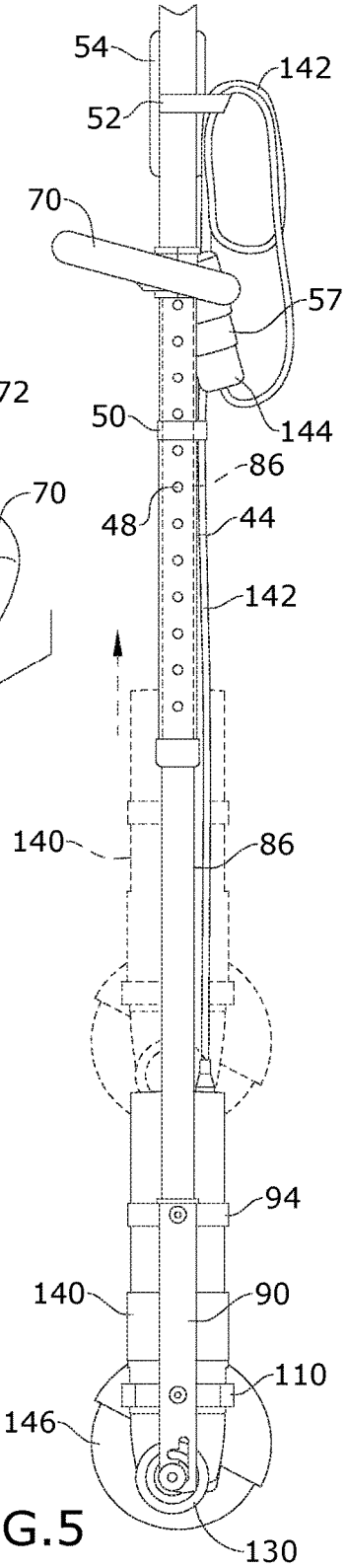
FIG. 5 is a detail side view of an exemplary embodiment of the present invention, demonstrating the selective height adjustment of a main pole and operatively engaged lower pole.

The distal/lower end of the main pole 44 may provide a series of spaced apart lower adjustment holes 48 through which snap components 84 and 88 may operatively associate in a telescopic manner to a lower pole 86 for providing adjustable functionality therewith. Specifically, the main pole 44 may movable between an extended and a contracted condition relative to the lower pole 86, as illustrated in FIG. 5. A lower dust cap 82 may be provided along a proximal/upper end of the lower pole 86.

Figure 3:
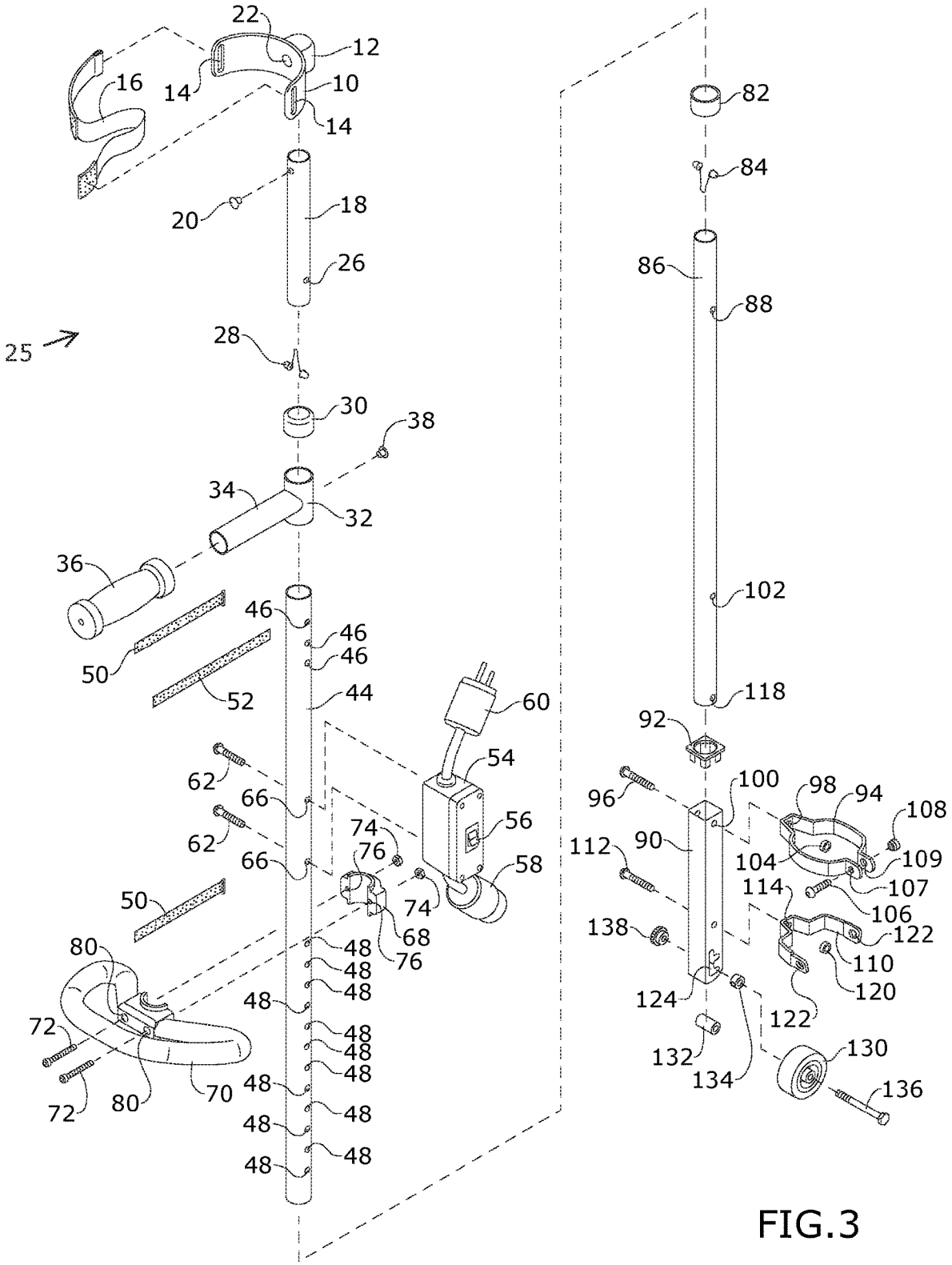
FIG. 3 is an exploded view of an exemplary embodiment of the present invention.
Figure 4:
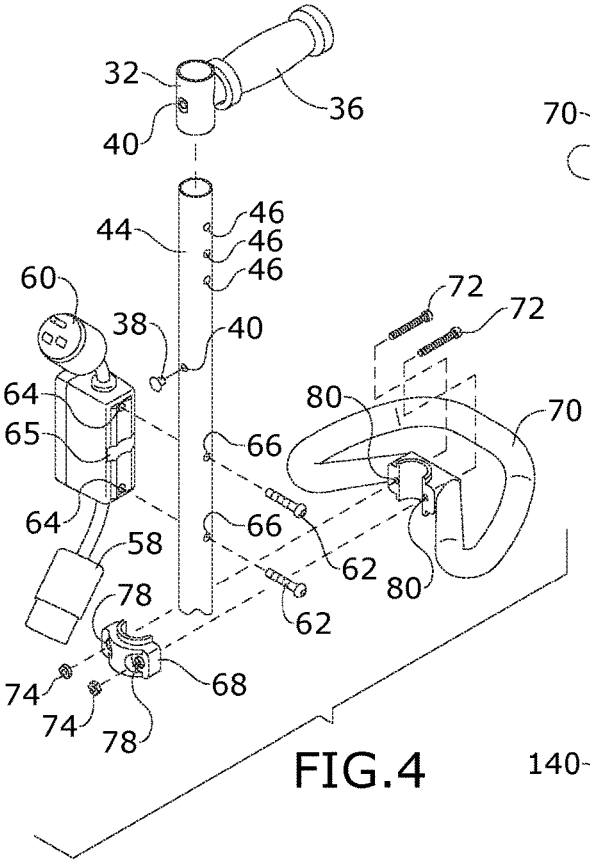
FIG. 4 is a detail exploded view of an exemplary embodiment of the present invention, taken from the reverse view as shown in FIG. 3.

A wheel mounting shaft 90 may be attachable to the proximal/upper end of the lower pole 86 by way of a shaft cap 92. The wheel mounting shaft 90 may enable attachment of a closable bracket 94, an open bracket 110, and the depth-adjusting single wheel 130. The closed and open brackets 94 and 110 may be connected to the wheel mounting shaft 90 and the lower pole 86 by way of closable mounting components 96, 98, 100, 102, and 104 and open mounting components 112, 114, 116, 118, and 120 respectively, as illustrated in FIG. 3. The closable bracket 94 may be closed at a distal end and thus attached to the power tool 140 by way of aligned closable bracket holes 107 and 109 engaging fasteners 106 and 108. The open bracket 94 may be attached to the power tool 140 via a fastener 148.

The closable bracket 94 may be spaced apart upward of the open bracket 110, the open bracket 100 disposed upward of the depth-adjusting single wheel 130, all generally align on a shared side of the wheel mounting shaft 90.

Figure 7A:
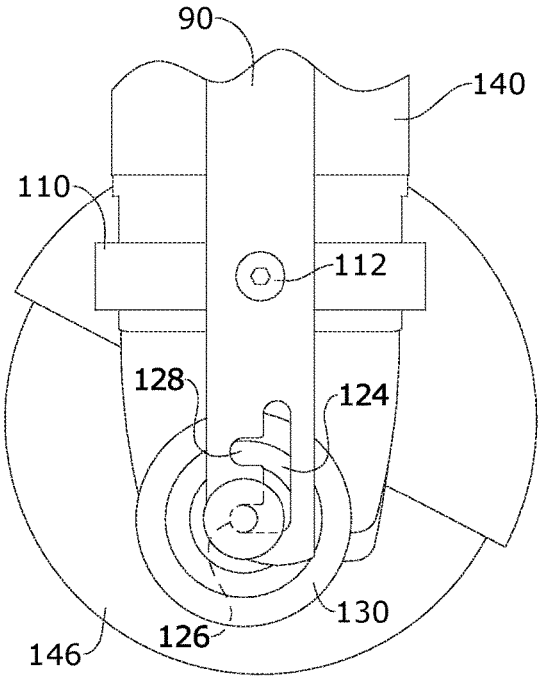
FIG. 7A is a detail side view of an exemplary embodiment of the present invention.
Figure 7B:
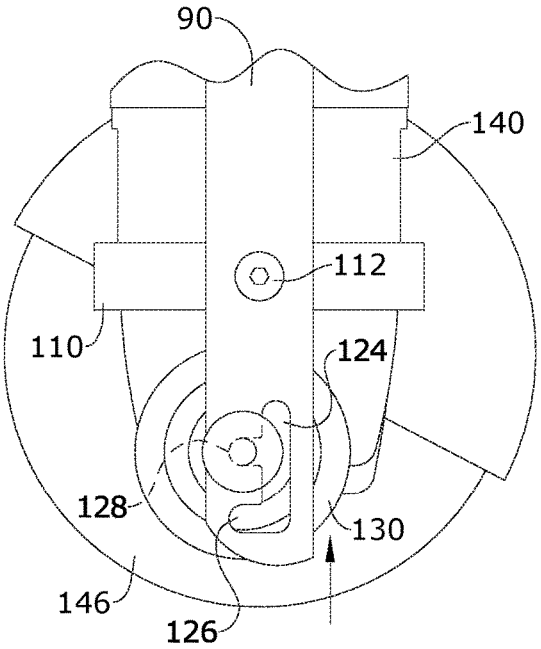
FIG. 7B is a detail side view of an exemplary embodiment of the present invention, demonstrating the height adjustment of single wheel 130.
Figure 8A:
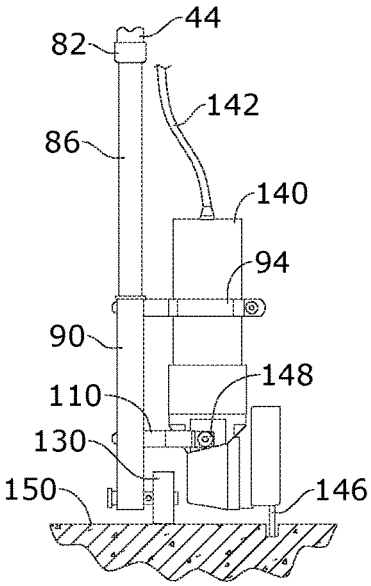
FIG. 8A is a front view of an exemplary embodiment of a completed loop of the present invention, shown in use.
Figure 8B:
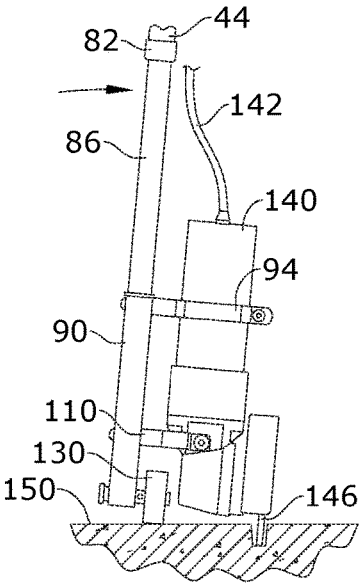
FIG. 8B is a front view of an exemplary embodiment of a completed loop of the present invention, demonstrating the pivoting motion to change the angle/depth of the applicator 146.
Figure 8C:
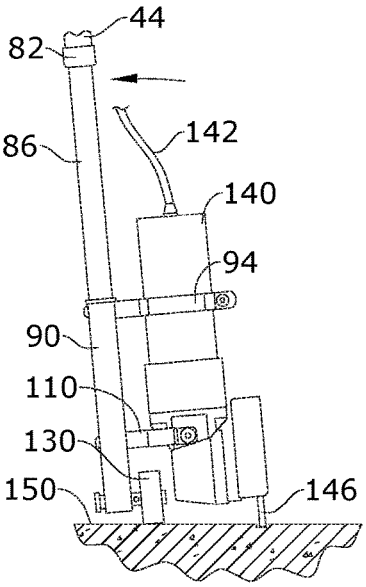
FIG. 8C is a front view of an exemplary embodiment of a completed loop of the present invention, demonstrating the pivoting motion to change the angle/depth of the applicator 146.

The wheel mounting shaft 90 may have a rectangular shape, and along one of the four surfaces of the rectangular shape the depth-adjusting single wheel 130 may be selectively and rotatably mounted thereto by way of a spacer 132, a shaft collar with set screw 134, a wheel first fastener 136, and a wheel second fastener 138. The wheel mounting shaft 90 may provide a wheel mounting slot 124 providing a plurality of position slots 126 and 128 along the length of the wheel mounting shaft 90. Whereby the first position slot 126 is disposed downward of the second position slot 128, as illustrated in FIGS. 7A and 7B. Thereby depth control of the single wheel 130 allows for better control of the depth of the operatively associated power tool 140/applicator 146, all while properly supporting its weight. The operative engagement of the wheel mounting slot 124 and the spacer 132 facilitates a pivotability of the single wheel 130 about a longitudinal axis of the wheel mounting shaft 90/lower pole 86, as illustrated in FIGS. 8B and 8C.

The single wheel 130 can be mounted on either side of the wheel mounting shaft 90; however, the central disposition of the single wheel 130—between the wheel mounting shaft 90 and the operative applicator 146 (demanded by the closable and open brackets 94 and 110 disposed directly upward of the single wheel 130)—provides greater balance and control. Furthermore, the single wheel 130 lessens the turning radius (compared to two-wheeled systems). Additionally, the baton-style handle 25 operatively associated with the pivotal depth-adjusting wheel 130 correlates to greater tilt and pivoting during application of the applicator 146.

A method of using the present invention may include the following. The power tool extension apparatus 200 disclosed above may be provided. An operator would attach their preferred power tool 140 to the closable and open brackets 94 and 110 so that its applicator 146 can be applied to a working surface 150, as illustrated in FIGS. 8A-8C. For example, the power tool 140 may be a grinder with a cutting blade 146 for cutting along a cutting surface 150. Then the operator electrically connects the power tool 140 to the power source 54.

Then the operator may lean on the baton-style handle 25, and in conjunction with the pivoting single wheel 130 manipulate the power tool 140 applicator 146 right and left to thereby allow intricate contours and paths to be followed. The forearm support afforded by the baton-style handle 25 as well as the auxiliary handle 70 facilitate balancing the device when applying the applicator 146 along the working surface 150 as well as when carrying the device to and from the work space.

The selective adjustability of the present invention enables an operator who is taller to telescopically move the main pole 44 to a more extended condition via the selective engagement of the snap button components 28 and 84 and upper and lower adjustment holes 46 and 48, respectively. Likewise, if the operator is shorter this process can be selected to move the main pole 44 to a more contracted condition.

The present invention can be associated different types of power tools 140 with the intention of using the power tool from an extended arm's length, while allowing for greater control and balance compared to the prior art. The types of power tools include, but are not limited to, grinders for concrete coatings and concrete polishing industries, but it can also have applications in the tile, paver and masonry industries.

It should be understood, of course, that the foregoing relates to exemplary embodiments of the invention and that modifications may be made without departing from the spirit and scope of the invention as set forth in the following claims.

What is claimed is:

1. An apparatus for supporting an extended operation of a mounted power hand tool along a working surface comprising:

a pole extending from a handle portion and a wheel portion;

a single wheel rotatably mounted to a first side of the wheel portion, wherein a circumference of the single wheel extends farther than the wheel portion so that the single wheel pivots relative to a longitudinal axis of the pole when the single wheel engage the working surface; and at least one bracket attached to said first side upward of the single wheel so that the single wheel is centrally disposed between an applicator of the mounted hand tool and said longitudinal axis.

2. The apparatus of claim 1, a plurality of position slots spaced apart along a longitudinal length of the wheel portion, wherein the single wheel can be operatively associated with any of the plurality of position slots, whereby the extension of said circumference relative to the wheel portion is selectively.

3. The apparatus of claim 1, wherein the at least one bracket comprises a closable bracket and an open bracket aligned and spaced apart along a longitudinal length of the wheel portion.

4. The apparatus of claim 1, wherein the handle portion provides a baton-style handle.

5. The apparatus of claim 4, wherein the baton-style handle comprises a cuff pole telescopically connected to the handle portion;

a handle transversely extending from a lower end of the cuff pole; and a cuff extending from an upper end of the cuff pole so that the cuff and the handle are spaced apart and aligned along a length of the cuff pole.

6. The apparatus of claim 5, wherein the cuff pole comprises an upper cuff pole telescopically connected to a lower cuff pole so that a distance between the spaced apart cuff and the handle is selectively adjustable.

7. The apparatus of claim 5, wherein the cuff further comprises an adjustable strap.

8. The apparatus of claim 5, further comprising an auxiliary handle connected to the cuff pole downward of and aligned with the handle.

9. The apparatus of claim 5, further comprising a power source for the mounted power hand tool, the power source connected to the handle portion.

10. An apparatus for supporting an extended operation of a mounted power hand tool along a working surface comprising:

a pole extending from a handle portion and a wheel portion;

a single wheel rotatably mounted to a first side of the wheel portion, wherein a circumference of the single wheel extends farther than the wheel portion so that the single wheel pivots relative to a longitudinal axis of the pole when the single wheel engage the working surface;

at least one bracket attached to said first side upward of the single wheel so that the single wheel is centrally disposed between an applicator of the mounted hand tool and said longitudinal axis;

a plurality of position slots spaced apart along a longitudinal length of the wheel portion, wherein the single wheel can be operatively associated with any of the plurality of position slots, whereby the extension of said circumference relative to the wheel portion is selectively adjustable;

a baton-style handle connected to the handle portion, the baton-style handle comprising:

a cuff pole telescopically connected to the handle portion;

a handle transversely extending from a lower end of the cuff pole; and a cuff extending from an upper end of the cuff pole so that the cuff and the handle are spaced apart and aligned along a length of the cuff pole, wherein the cuff pole comprises an upper cuff pole telescopically connected to a lower cuff pole so that a distance between the spaced apart cuff and the handle is selectively adjustable, and wherein the cuff further comprises an adjustable strap;

an auxiliary handle connected to the cuff pole downward of and aligned with the handle; and a power source for the mounted power hand tool, the power source connected to the handle portion.

* * * * *